US008467712B2

(12) United States Patent
Kodera et al.

(10) Patent No.: US 8,467,712 B2
(45) Date of Patent: Jun. 18, 2013

(54) FIXING DEVICE AND IMAGE FORMING APPARATUS USING THE SAME

(75) Inventors: Tetsuro Kodera, Kanagawa (JP); Takashi Matsubara, Kanagawa (JP); Naoyuki Egusa, Kanagawa (JP); Makoto Furuki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 226 days.

(21) Appl. No.: 13/089,831

(22) Filed: Apr. 19, 2011

(65) Prior Publication Data

US 2012/0093552 A1 Apr. 19, 2012

(30) Foreign Application Priority Data

Oct. 15, 2010 (JP) ..... P2010-232531

(51) Int. Cl.
*G03G 15/20* (2006.01)

(52) U.S. Cl.
USPC ..... 399/336

(58) Field of Classification Search
USPC ..... 219/216; 399/336, 337
See application file for complete search history.

(56) References Cited

U.S. PATENT DOCUMENTS

| | | | | |
|---|---|---|---|---|
| 6,175,715 | B1 | 1/2001 | Hirao et al. | |
| 6,674,990 | B2 * | 1/2004 | Rohde et al. | 399/336 |
| 8,260,185 | B2 * | 9/2012 | Matsubara et al. | 399/336 |

FOREIGN PATENT DOCUMENTS

| | | |
|---|---|---|
| JP | A-S55-162257 | 11/1980 |
| JP | A-S9-128569 | 7/1984 |
| JP | A-S61-005271 | 1/1986 |
| JP | A-S62-181969 | 11/1987 |
| JP | A-06-301304 | 10/1994 |
| JP | A-07-191560 | 7/1995 |
| JP | A-11-202653 | 7/1999 |
| JP | A-2000-131893 | 5/2000 |

OTHER PUBLICATIONS

Office Action issued Jan. 8, 2013 in counterpart Japanese Application No. 2010-232531, with English translation.

* cited by examiner

*Primary Examiner* — Hoang Ngo
(74) *Attorney, Agent, or Firm* — Oliff & Berridge, PLC

(57) ABSTRACT

A fixing device includes a laser light source that irradiates an irradiation region with a laser light, the irradiation region extending along a direction crossing a transporting direction of a recording medium with respect to a heating-fixable image which is on the recording medium. The fixing device further includes; a reflective member that is provided to enclose the irradiation region and includes a reflective surface reflecting a reflected light so that the irradiation region is re-irradiated with the reflected light from the irradiation region by the laser light radiated from the laser light source; and a light absorption member that is provided so as to continue to an end of a side of the reflective member directed to the recording medium and includes a portion facing a transporting surface of the recording medium and extending toward an outside of the reflective member, and is capable of absorbing the laser light.

8 Claims, 17 Drawing Sheets

FIXING DEVICE AND IMAGE FORMING APPARATUS USING THE SAME

CROSS-REFERENCE TO RELATED APPLICATION

This application is based on and claims priority under 35 USC 119 from Japanese Patent Application No. 2010-232531 filed on Oct. 15, 2010.

BACKGROUND

Technical Field

The present invention relates to a fixing device and an image forming apparatus using the same.

SUMMARY

According to an aspect of the invention, a fixing device includes:

a laser light source that irradiates an irradiation region with a laser light, the irradiation region extending along a direction crossing a transporting direction of a recording medium with respect to a heating-fixable image which is on the recording medium;

a reflective member that is provided to enclose the irradiation region and includes a reflective surface reflecting a reflected light so that the irradiation region is re-irradiated with the reflected light from the irradiation region by the laser light radiated from the laser light source; and a light absorption member that is provided so as to continue to an end of a side of the reflective member directed to the recording medium and includes a portion facing a transporting surface of the recording medium and extending toward an outside of the reflective member, and is capable of absorbing the laser light.

BRIEF DESCRIPTION OF THE DRAWINGS

Exemplary Embodiments of the invention will be described in detail based on the following figures, wherein:

FIG. 7A is a cross sectional diagram of a main part of FIG. 4, and FIG. 7B is a diagram illustrating the light intensity distribution of a reflected light;

DETAILED DESCRIPTION (Outline of Exemplary Embodiment)

First, an outline of an embodiment model of a fixing device in which the invention is applied will be described.

Figure 1:
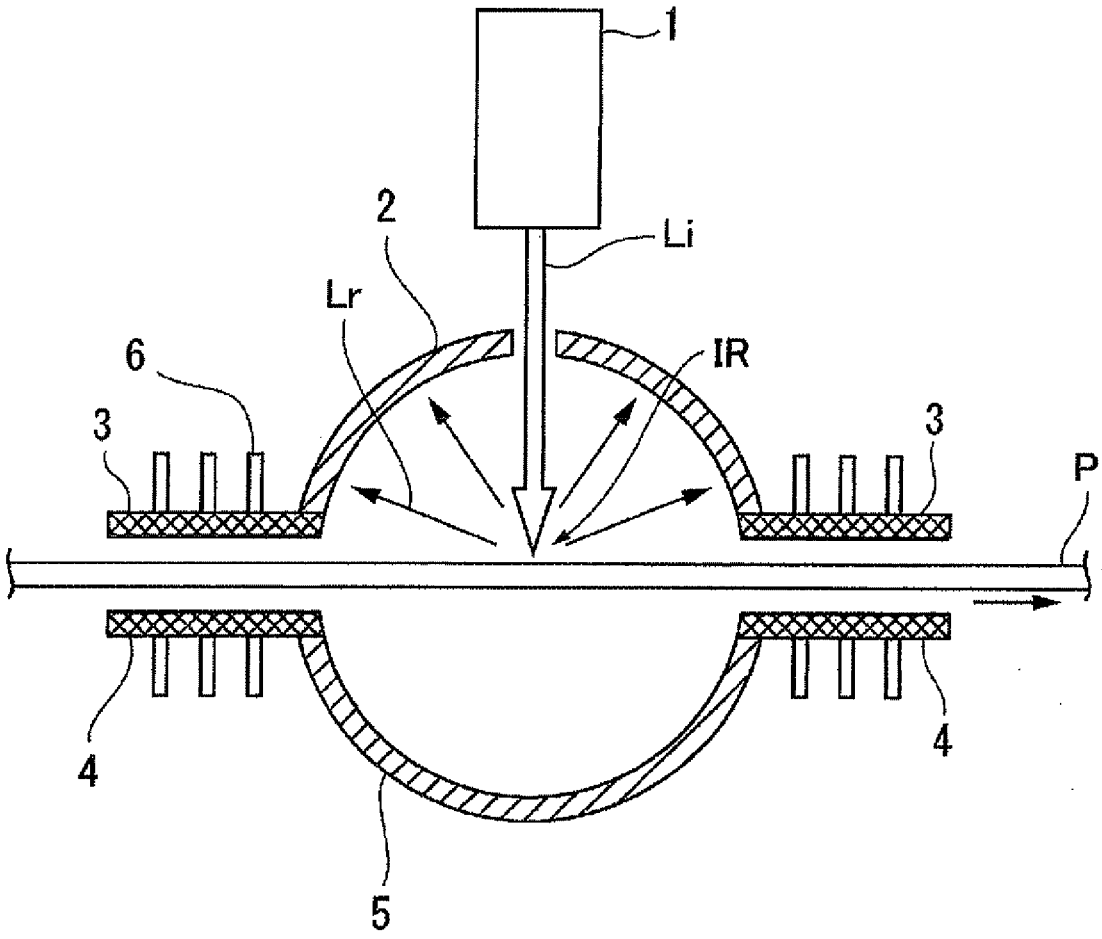
FIG. 1 is an explanatory diagram illustrating an outline of a fixing device according to an embodiment model embodying the invention.

FIG. 1 is an explanatory diagram illustrating a fixing device according to an embodiment model embodying the invention.

In FIG. 1, the fixing device includes: a laser light source 1 that irradiates an irradiation region IR with a laser light, the irradiation region is extended along a direction crossing a transporting direction of a recording medium P with respect to a heating-fixable image which is on the recording medium P; a reflective member 2 that is provided to enclose the irradiation region IR and includes a reflective surface reflecting a reflected light Lr so that the irradiation region IR is re-irradiated with the reflected light Lr from the irradiation region IR by the laser light Li radiated from the laser light source 1; and a light absorption member 3 that is provided so as to continue to an end of a side directed to the recording medium P of the reflective member 2 and includes a portion facing a transporting surface of the recording medium P and extending toward the outside of the reflective member 2, wherein the absorption member is capable of absorbing the laser light Li.

Here, as a representative material forming an image on the recording medium P, a toner used in an electro-photographic method may be exemplified. However, the material forming the image is not limited to the toner, for example, the material may be ink of a heating fusion type used in an ink jet method or the like.

Moreover, as the recording medium P used, a continuous form (for example, a roll paper) or a sheet-like form (for example, cut paper) may be exemplified as representative examples. However, as the medium, the recording medium is not limited only to being a paper medium but may also be a film medium or the like.

Moreover, as a representative form of the laser light source 1, a laser array type may be exemplified in which plural of emitting portions of the laser light Li is installed in one row along an extended direction of the irradiation region IR.

The reflective surface side of the reflective member 2 may be, for example, a curved shaped-mirror surface. Further, the reflective surface side may be a reflective surface having recursiveness or a scattering surface, and may include a reflective surface which reflects so that the irradiation region IR is re-irradiated with the reflected light Lr. At this time, the irradiation region IR re-irradiated with the light may be re-radiated to a region including the irradiation region IR, and it is not limited to the irradiation region IR.

Moreover, since the light absorption member 3 is provided so as to be continuous with an end of a side directed to the recording medium P of the reflective member 2, the laser light Li does not leak between the reflective member 2 and the light absorption member 3. Further, since the light absorption member 3 includes the portion facing the transporting surface of the recording medium P, the laser light Li is effectively absorbed to the light absorption member 3. In addition, the light intensity of the laser light Li, which is leaked from an opening section between the light absorption member 3 and the recording medium P toward the outside, is greatly decreased. Further, the light absorption member 3 may include a portion facing the transporting surface of the recording medium P, and, for example, may include a portion which is extended along the reflective surface of the reflective member 2. "Facing the transporting surface of the recording medium P" means that the portion may be parallel or not parallel to the transporting surface, or may include the configuration which faces and extends to the transporting surface of the recording medium P. The light absorption member 3 may have heat resistance and absorb the laser light Li, and, for example, the light absorption member may include an aluminum alloy processed with a black color-anodic film formation.

Moreover, a facing member may be provided on a rear surface side of the recording medium P, and the facing member may be oppositely disposed so that the recording medium P is held toward the laser light source 1 side. Further, a transmission light which has been transmitted through the recording medium P of the laser light Li may be reflected on the facing member (a flat plate shaped member or a curved shape member). Further, the other curved shape reflective member (a rear surface side reflective member 5 described below) may be provided in a position which is separated from the recording medium P, or nothing may be provided.

Figure 2A:
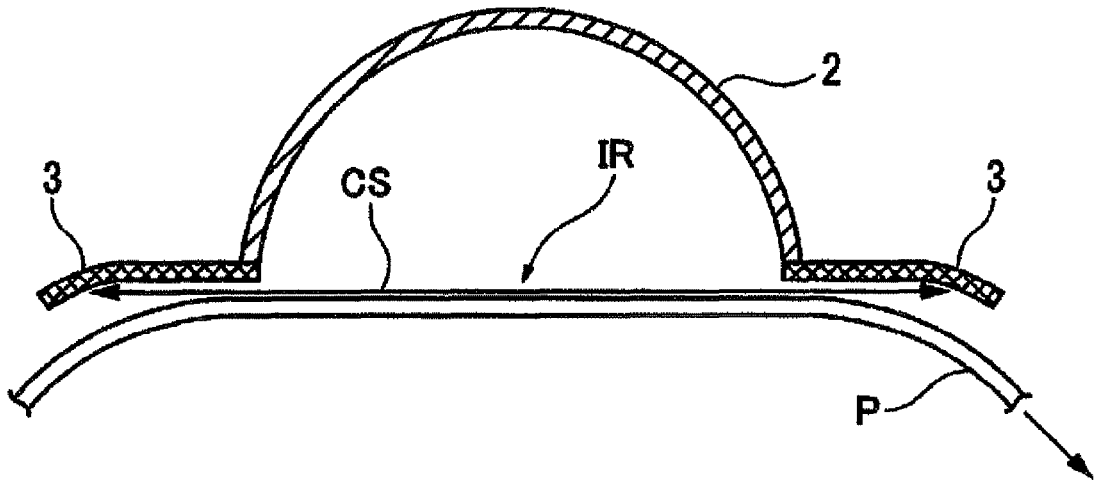
FIGS. 2A and 2B are explanatory diagrams illustrating a desirable configuration of a light absorption member.
Figure 2B:
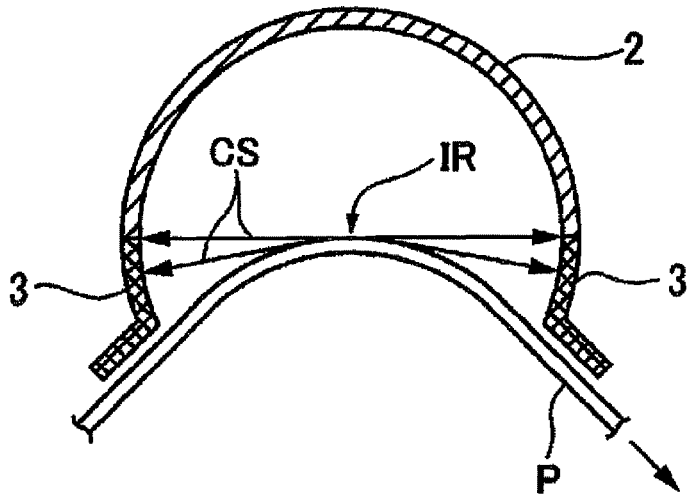

Moreover, from the view of preventing the leakage of the reflected light (including the scattering light) from the irradiation region IR of the laser light Li radiated in the irradiation region IR to the outside, as illustrated in FIGS. 2A and B, the light absorption member 3 may include a surface which crosses with respect to a surface CS (meaning a surface which is extended in the tangential direction, and hereinafter, referred to as "tangential surface") abutting the surface of the recording medium in the irradiation region IR. Here, FIG. 2A illustrates a case where the recording medium P includes the irradiation region IR of the flat region, and FIG. 2B illustrates a case where the recording medium P includes the irradiation region IR of the curved region. Since the number of tangential surfaces CS is one in FIG. 2A, the light absorption member 3 may have the surface which crosses the tangential surface CS. On the other hand, in the irradiation region IR of the curved region as illustrated in FIG. 2B, plural of tangential surfaces CS is assumed, and the absorption member may have the surfaces which cross the tangential surface CS.

Therefore, a reflected light Lr is absorbed by the light absorption member 3 even when the reflected light Lr is reflected in the direction which is along the tangential surface CS. Further, the reflected light Lr reflected from the irradiation region IR by the laser light Li radiated from the laser light source 1 toward the irradiation region IR does not leak from between the light absorption member 3 and the recording medium P to the outside. In addition, needless to say, the transporting path of the recording medium P is set so as to match the configuration of the light absorption member 3.

Moreover, as illustrated in FIG. 1, from the view of further effectively improving the light absorption performance in the region in which the light absorption member 3 is installed, a rear surface side light absorption member 4 capable of absorbing the laser light Li may be provided in the region facing the light absorption member 3 which interposes the recording medium P therebetween. Therefore, since the recording medium P is interposed between the light absorption member 3 and the rear surface side light absorption member 4, the transmission light which has been transmitted through the recording medium P is also effectively absorbed in the rear surface side light absorption member 4.

Moreover, from the view of using effectively the transmission light of which the laser light Li radiated in the irradiation region IR which has been transmitted through the recording medium P, in an aspect in which the facing member for abutting the rear surface side of the recording medium P is not provided, a rear surface side reflective member 5 for reflecting the transmission light may be further provided so that the region of the rear surface side of the recording medium P corresponding to the irradiation region IR is re-irradiated with the transmission light radiated from the laser light source 1 and transmitted through the recording medium P. Further, the reflective member 5 may be provided in the region facing the reflective member 2 which interposes the recording medium P therebetween.

Figure 3:
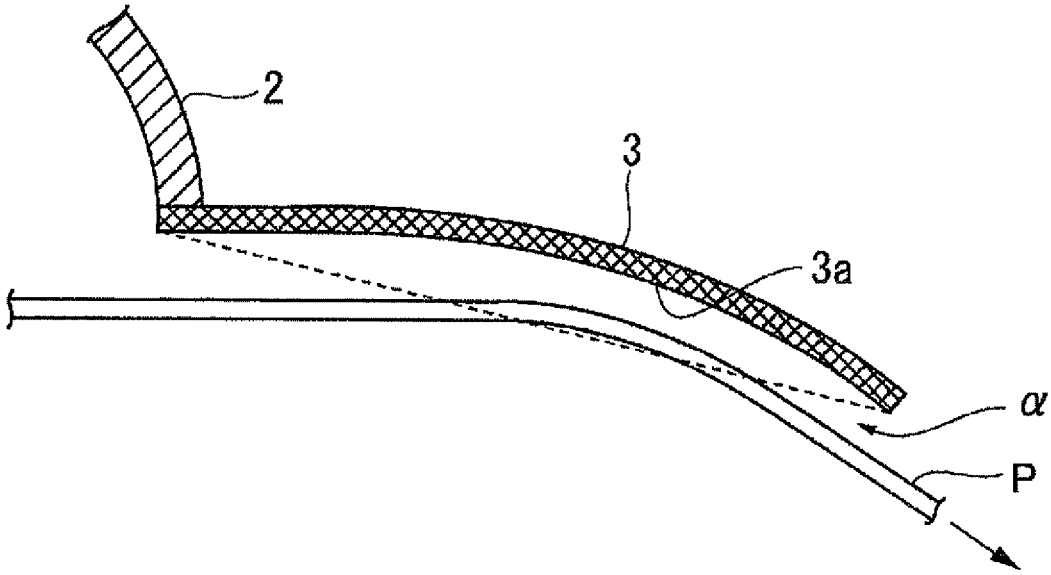
FIG. 3 is an explanatory diagram illustrating a more desirable configuration of a light absorption member.

Moreover, from the view of further suppressing the leakage of the laser light Li to the outside, as illustrated in FIG. 3, the light absorption member 3 may be provided so that only a facing surface 3*a* of the light absorption member 3 which faces the transporting surface of the recording medium P is viewed when viewing the irradiation region IR from the opening section α between the light absorption member 3 and the recording medium P at an outside end. The outside end is one other than the irradiation region IR side of portions of the light absorption member 3 facing the transporting surface of the recording medium P. In this manner, the irradiation region IR or the reflective surface of the reflective member 2 is not viewed from the opening section α between the outside end other than the irradiation region IR of the light absorption member 3 and the recording medium P, and the leakage of the laser light Li to the outside is suppressed.

In this case, the configuration of the light absorption member 3 is not especially limited, and the following configuration may be adopted. That is, in the portion of the light absorption member 3 facing the transporting surface of the recording medium P, when drawing a straight line (a dotted line of FIG. 3) connecting two different points in the transporting direction of the recording medium of the facing surface 3*a* which faces the recording medium P, the light absorption member 3 and the transporting path of the recording medium P may be constituted so that the facing surface 3*a* of the light absorption member 3 includes portions which are further distant from the recording medium P than the straight line and the transporting path of the recording medium P is installed in the portions. Further, the two points are not especially limited, the two points may be both ends of the light absorption member 3, and two points other than these points may be adopted.

Moreover, from the view of stabilizing the performance of the light absorption in the light absorption member 3, as illustrated in FIG. 1, a cooling unit 6 for cooling the light absorption member 3 may be further provided. As a representative form of the cooling unit 6, a heat-radiation member may be exemplified. Further, the cooling unit 6 may be installed in the light absorption member 3. In addition, for example, in the aspect including the rear surface side light absorption member 4, the cooling unit 6 may also be installed in the rear surface side light absorption member 4. However, since only the transmission light which has been transmitted through the recording medium P is absorbed in the rear surface side light absorption member 4, the increase in temperature of the light absorption member 4 is smaller than that of the light absorption member 3. Therefore, the cooling unit 6 need not be installed in the rear surface side light absorption member 4.

When applying the fixing device to the image forming apparatus, an image forming portion for forming a heating-fixable image on the recording medium P, and the fixing device for fixing the image which is formed on the recording medium P in the image forming portion are provided, and the fixing device described above may be used as the fixing device.

Further, in the image forming apparatus, the recording medium P, which is continuous along the transporting direction, may be used as the recording medium P.

Next, the invention will be described in further detail based on the embodiments illustrated in the drawings.

(First Exemplary Embodiment)

Figure 4:
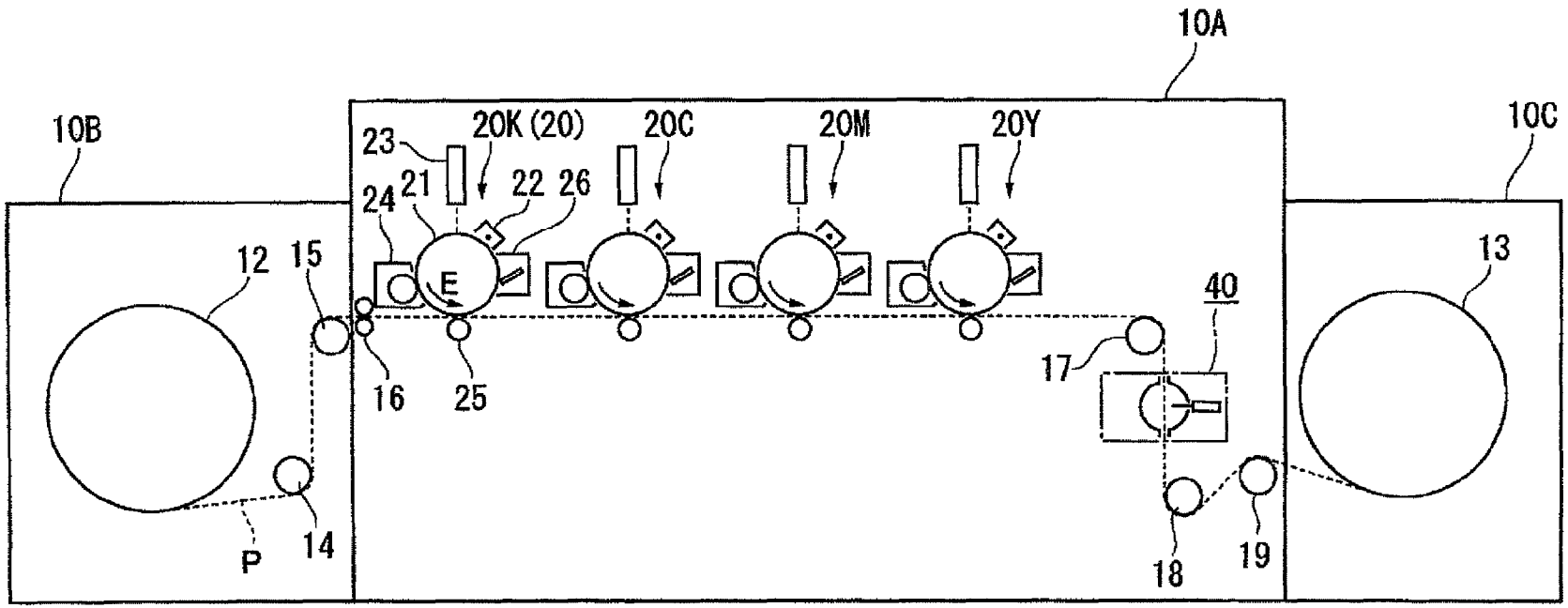
FIG. 4 is an explanatory diagram illustrating an outline of an entire configuration of an image forming apparatus according to a first embodiment of the invention.

FIG. 4 is an explanatory diagram illustrating an entire configuration of an image forming apparatus according to the first embodiment of the invention in which the fixing device of the embodiment model described above is applied.

The image forming apparatus of the first embodiment uses the continuous state recording medium P as the recording medium. The image forming apparatus of the embodiment includes: an image forming body device 10A that forms the image on the recording medium P; a feeding device 10B that feeds the recording medium P to both sides of the image forming body device 10A; and a receiving device 10C for receiving the recording medium P on which the image is formed. Further, a roll-shaped recording medium may be used as the recording medium P. For example, a collapsed recording medium may be used, but the first embodiment is described as the roll-shaped recording medium.

For example, the image forming body device 10A of the first embodiment uses an electro-photographic method. The image forming body device 10A includes: image forming portions 20 (specifically, a yellow image forming portion 20Y, a magenta image forming portion 20M, a cyan image forming portion 20C, and a black image forming portion 20K) of respective colors for forming toner images of plural of colors on the recording medium P by using, for example, toners of four colors; a fixing device 40 for fixing the toner images which are formed in a state where the toner images are multiplexed on the recording medium P in the image forming portions 20 of the respective colors; and plural of appropriately installed roll members 16 to 19, or the like.

Here, the roll member 16 is a position adjusting roll which performs the position adjustment when guiding the recording medium P to the image forming portions 20, and the roll member 17 is a pull-suspension roll which guides the recording medium P toward the fixing device 40. Further, the roll members 18 and 19 are tension applying rolls which properly apply the tension when transporting the recording medium P toward the receiving device 10C after fixing.

Moreover, since the image forming portions 20 of the respective colors have approximately the same configuration except for the toners used, the black image forming portion 20K is described as a representative example. The black image forming portion 20K includes a cylindrical photoconductor drum 21 which has a photoconductive layer (not shown in drawings) and is rotated to the direction of an arrow E. In the periphery of the photoconductor drum 21, a charging unit 22 for charging the photoconductive layer of the photoconductor drum 21 to a predetermined electric potential, an exposure unit 23 for selectively irradiating the photoconductive layer charged in the charging unit 22 by using, for example, laser light and for forming an electrostatic latent image in the photoconductor drum 21, a developing unit 24 for visualizing by developing the electrostatic latent image formed by the exposure unit 23 through the toner, a transfer unit 25 for transferring the toner image, which is on the photoconductor drum 21, on the recording medium P, a cleaning unit 26 for cleaning the toner which remains on the photoconductor drum 21 after transferring, or the like are arranged.

Moreover, the arrangement of the toner colors of the image forming portions 20 is not limited to this, other arrangements may be used, and needless to say, only one of the image forming portions 20 may be provided.

Further, the feeding device 10B includes: a feeding roll 12 for holding the recording medium P wound as a roll on a core material; tension applying rolls 14 and 15 for applying the tension while transporting so as to feed the recording medium P to the image forming body device 10A side, and the like. On the other hand, the receiving unit 10C includes a winding up roll 13 for winding and receiving the recording medium P on the core material, or the like.

In the image forming apparatus, the toner images of the respective colors are transferred on the recording medium P fed from the feeding device 10B in the image forming portions 20 of the respective colors of the image forming body device 10A, and are multiplexed on the recording medium P. The recording medium P on which the unfixed and multiplexed toner images are formed is fixed in the fixing device 40, and then, wound and received in the receiving device 10C.

Next, in the image forming apparatus described above, the fixing device 40 will be described based on FIG. 5.

Figure 5:
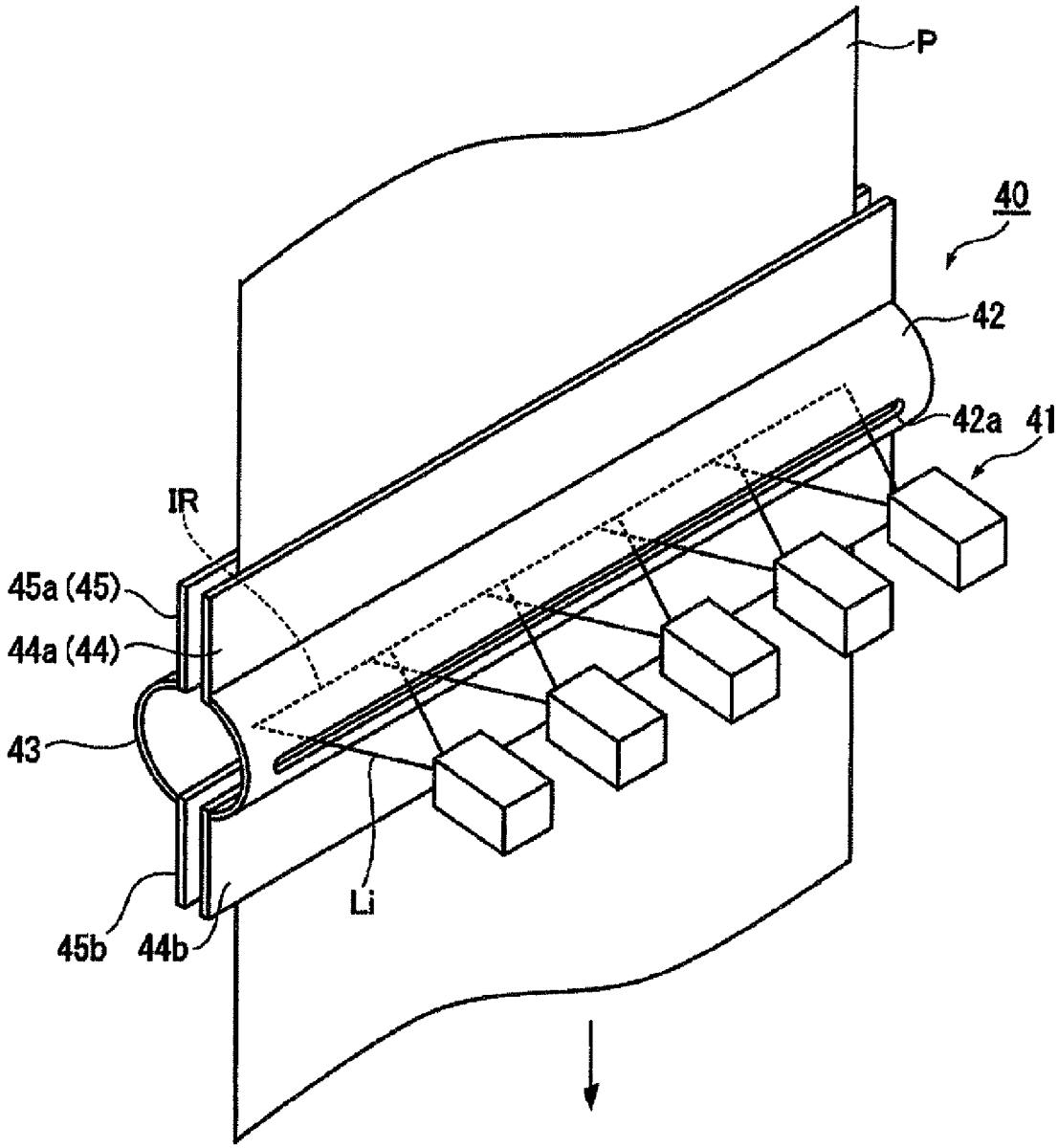
FIG. 5 is a perspective diagram illustrating an outline of a fixing device of the first embodiment.

In FIG. 5, the fixing device 40 of the embodiment includes: a laser array 41 as the laser light source which is extended on the recording medium P with a straight line and radiates the laser light Li toward the irradiation region IR; a half-cylindrical reflective member 42 which is provided to enclose the irradiation region IR and includes a reflective surface for reflecting reflected light so that the reflected light reflected from the irradiation region IR rather than the laser light Li radiated from the laser array 41 re-radiates toward the irradiation region IR; a half-cylindrical reflective member 43 of a rear surface side which is installed with the reflective member 42 which interposes the recording medium P and reflects a transmission-light so that the transmission light, which is radiated from the laser array 41 and transmitted to the recording medium P, re-radiates toward the region of the rear surface side of the recording medium P; a light absorption member 44 (44*a* and 44*b*) capable of absorbing the laser light Li, and which is installed so as to be continuous with an end of a side directed to the recording medium P of the reflective member 42, and which includes a portion which faces a transporting surface of the recording medium P and is extended toward the outside of the reflective member 42; and a rear surface side light absorption member 45 (45*a* and 45*b*) which is capable of absorbing the laser light Li and is installed in a region facing the light absorption member 44 which interposes the recording medium P.

It is illustrated in the embodiment that the laser array 41 uses five high-output semiconductor lasers. However, the number of lasers, for example, is not limited, and any number of lasers may be used. However, a length capable of covering a width of the image in the width direction of the recording medium P is necessary. Further, the laser array 41 includes, for example, an optical system so as to focus the laser light Li in the irradiation region IR which is on the recording medium P. Moreover, since the laser light Li emitted from the adjacent high-output semiconductor array is overlapped in the mutual end portions, the irradiation region IR is set so that the irradiation intensity of the laser light Li is approximately the same along the extended direction of the irradiation region IR.

Moreover, the reflective member 42 includes a long slot 42*a* in order to radiate the laser light Li from the laser array 41 toward the irradiation region IR in the approximate center portion of the half-cylinder. Further, in respect to the laser light Li from the laser array 41 to the reflective member 42, needless to say, for example, a shield member (not shown) shields the laser light for preventing the leakage of the laser light Li to the outside.

Figure 6:
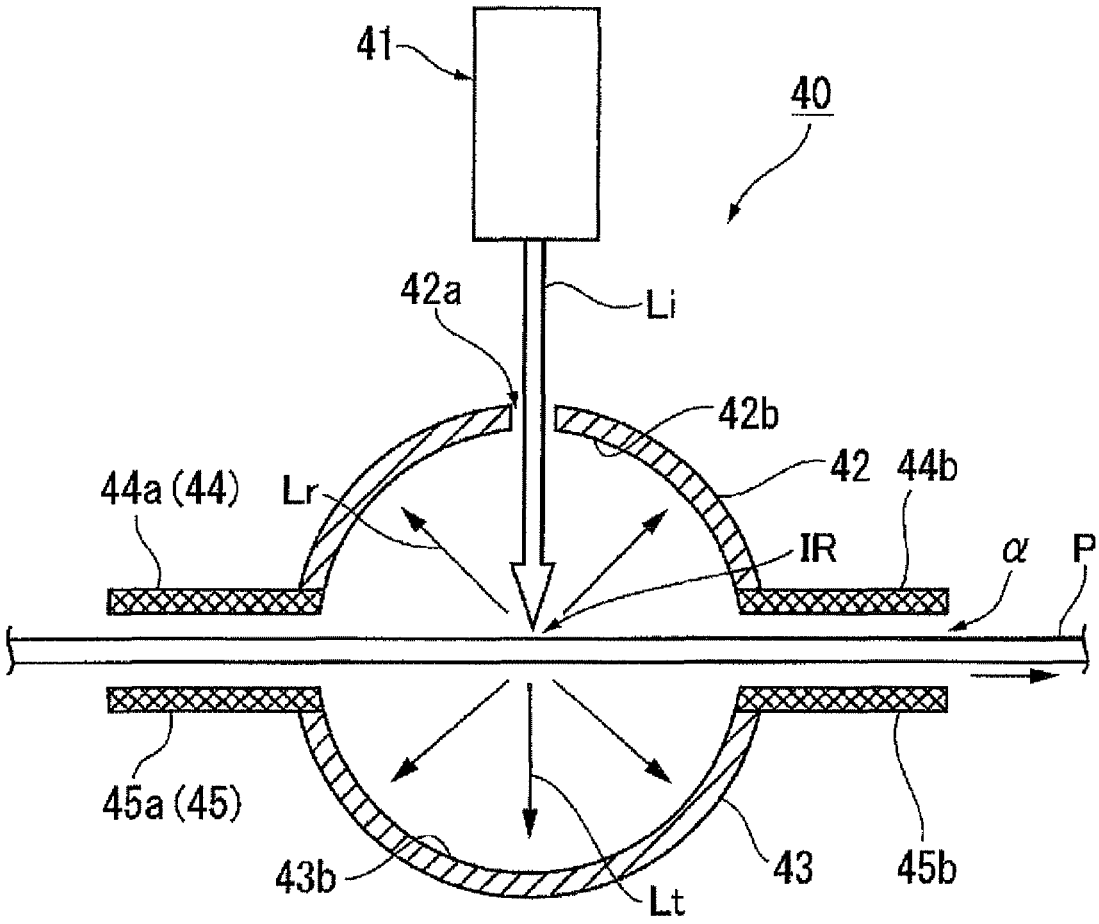
FIG. 6 is an explanatory diagram as viewed from a cross sectional direction of the fixing device of the first embodiment.

FIG. 6 illustrates a cross section when viewing the fixing device 40 of the first embodiment in a transverse direction.

In FIG. 6, the laser light Li radiated from the laser array 41 proceeds from the slot 42*a* of the reflective member 42 toward the irradiation region IR which is on the recording medium P. The reflected light Lr, which is reflected from the irradiation region IR of the laser light Li radiated on the irradiation region IR, is reflected at the reflective surface 42*b* of the reflective member 42, and is re-radiated toward the irradiation region IR.

On the other hand, the transmission light Lt transmitted through the recording medium P of the laser light Li is re-radiated to the region corresponding to the irradiation region IR at the rear surface side of the recording medium P by the reflective surface 43*b* of the rear surface side reflective member 43.

The reflected light Lr is reflected over substantially all directions from the irradiation region IR which is on the recording medium P. However, most of the reflected light is reflected at the reflective surface 42*b* of the reflective member 42, and the intensity thereof is decreased by repeating the reflection described above.

However, since it is necessary to maintain a gap between the reflective member 42 and the recording medium P in order to transport the recording medium P, an opening section a is formed. Therefore, the reflective light Lr, which is reflected in a direction close to the surface of the recording medium P from the irradiation region IR, is not reflected at the reflective member 42 and proceeds unchanged to the side of the opening section α.

Figure 7A:
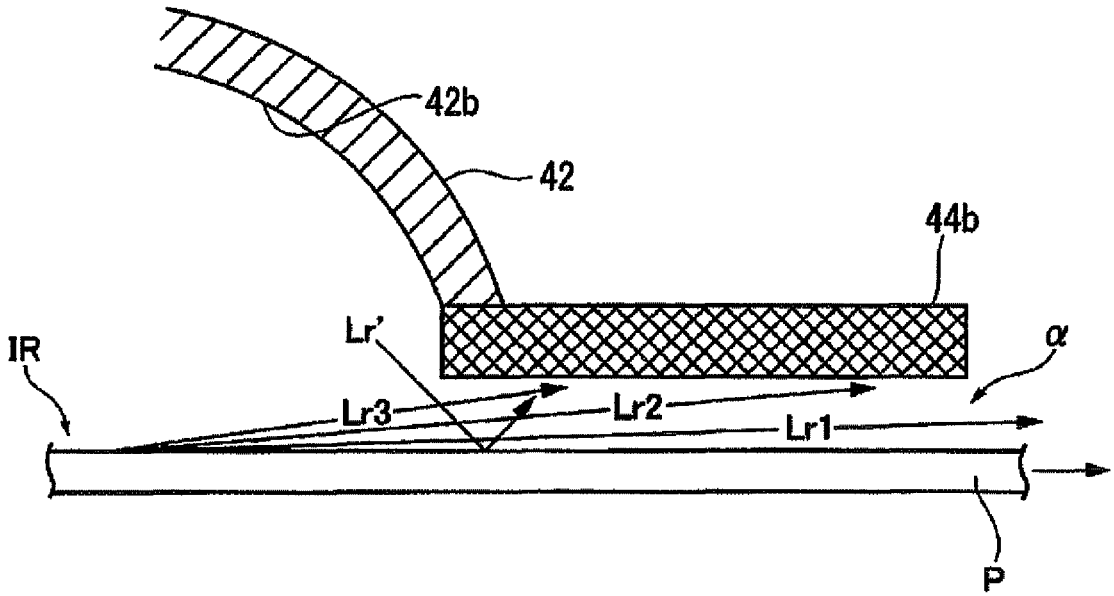
FIGS. 7A and 7B are explanatory diagrams illustrating an operation of the light absorption member, where

FIG. 7A is a partial enlarged view of FIG. 6, and illustrates a relation between the light absorption member 44*b* and the recording medium P.

As illustrated in FIG. 7A, in the reflected light Lr (Lr1 to Lr3) which is directed to between the reflective member 42 and the recording medium P, since the reflected light Lr2 and Lr3 are directed to the light absorption member 44*b* in this case, the reflected light Lr2 and Lr3 are substantially absorbed in the absorption member. Therefore, the light, which is leaked to the outside through the opening section α between the light absorption member 44*b* and the recording medium P, is substantially the reflected light Lr1. Further, for example, though assuming that the reflected light Lr' strikes the recording medium P and is reflected, the reflected light is absorbed at the light absorption member 44*b*.

Figure 7B:
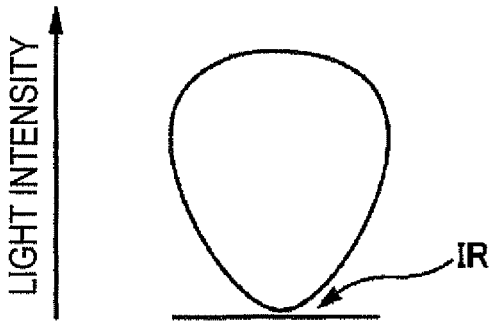

Generally, the light intensity distribution of the reflected light of the light radiated on the recording medium P is as illustrated in FIG. 7B. That is, as there are some uneveness on the surface of the recording medium P, the reflected light has a somewhat spread distribution in the direction along the surface of the recording medium P; however, the light intensity of the component which is parallel to the recording medium P becomes weaker toward the parallel.

Therefore, the light intensity of the light Lr1 illustrated in FIG. 7A is also weak, and as the light leaked to the outside through the opening section α between the light absorption member 44*b* and the recording medium P, the light intensity thereof is suppressed to be weak.

If the light absorption member 44*b* is not installed, for example, the lights of Lr1 to Lr3 are leaked, and the light intensity of the light leaked from the opening section α is somewhat strong.

Here, the light absorption member 44*b* of the one side is described. However, as illustrated in FIG. 6, the light absorption member 44*a* of the other side is similar. Further, this is similar to the rear surface side-absorption member 45 (45*a* and 45*b*).

Generally, in the product using the laser light, a class classification or a reference level is defined by "a safety standards of laser products" of JIS C 6802.

Therefore, in the embodiment, the laser light discharged to the outside from the opening region (here, corresponding to the opening section cc between the recording medium P and the light absorption member 44) of the fixing device 40 needs to satisfy an AEL (Accessible Emission Limit) of the class 1 defined in JIS C 6802. Specifically, the leaked light measured by a detector, which has a diameter of 7 mm and is installed at 100 mm away from the opening section α, needs to be within the AFL regardless of location. That is, when the wavelength of the laser light used is near-infrared, for example, it is necessary that the wavelength is equal to or less than $2.3\times10^{-4}$ W at the time of continuous oscillation.

According to the exemplary embodiment, since the reflective member 42 and the rear surface side reflective member 43 are used, and the light absorption member 44 and the rear surface side light absorption member 45 are used, a use efficiency of the laser light Li is enhanced during fixing. Further, the safety of the leaked light (the light leaked from the opening section α) is also improved. In addition, needless to say, the light intensity of the leaked light satisfies the standard described above.

Moreover, in the exemplary embodiment, the aspect in which the rear surface side reflective member 43 and the rear surface side absorption member 45 are used is illustrated. However, the reflective member 43 and the light absorption member 45 need not be used. In this case, the laser output may be slightly increased as compared to a case where the rear surface side reflective member 43 is installed, but needless to say, the light intensity of the leaked light satisfies the above described standard.

Figure 8:
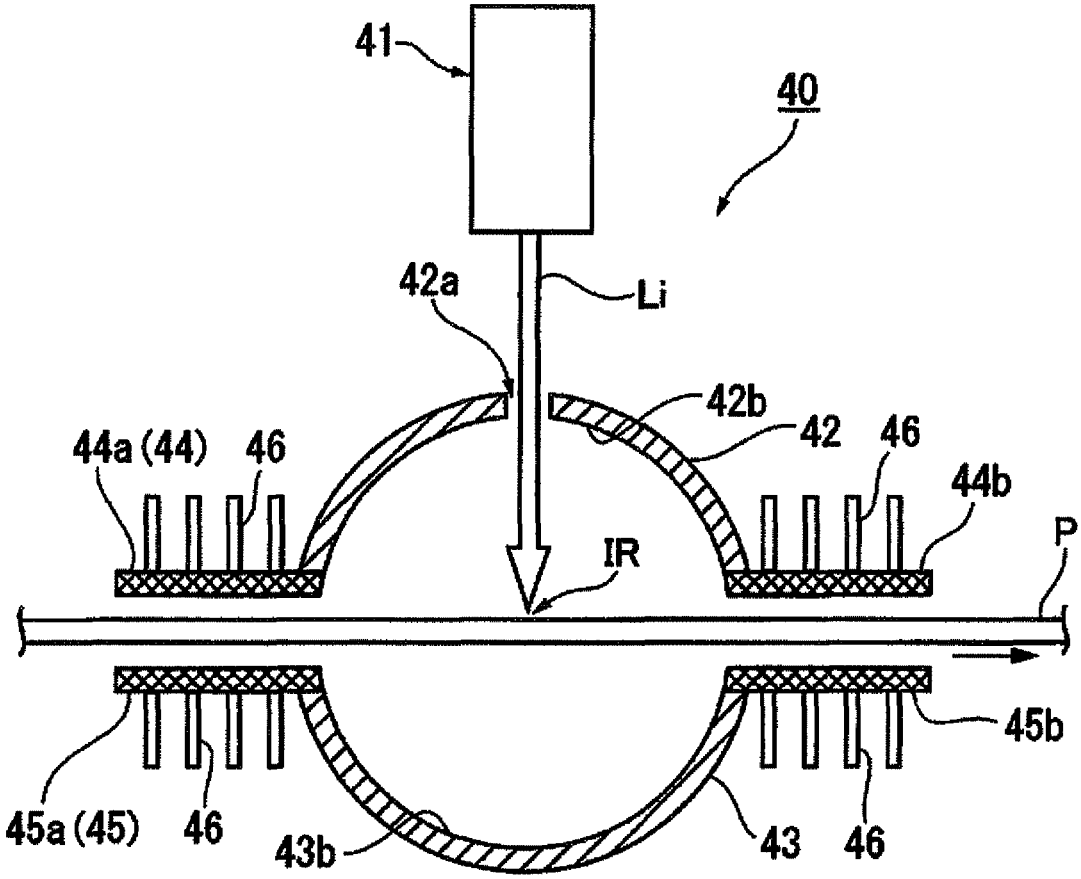
FIG. 8 is an explanatory diagram illustrating a fixing device of a first modification of the first embodiment.

FIG. 8 illustrates a first modification of the fixing device 40 of the first exemplary embodiment, and heat-dissipation pins 46 are attached to the light absorption member 44 (44*a* and 44*b*) and the rear surface side light absorption member 45 (45*a* and 45*b*) as a cooling unit.

Since the laser light Li is absorbed in the light absorption member 44 and the rear surface side light absorption member 45, temperatures of the members are increased. However, deformation due to heat expansion through the increase of temperatures of the members is suppressed by installing the heat-dissipation pins 46. Further, the performance of the light absorption is stably maintained.

Here, the aspect in which the heat-dissipation pins 46 are installed as the cooling unit is illustrated, but ventilation may be attached to the heat-dissipation pins 46. For example, the light absorption member 44 may be cooled by the ventilation without installing the heat-dissipation pins 46. Moreover, when ventilation is performed, it is preferable in the view of fixing efficiency that the ventilation directed to the irradiation region IR is suppressed.

Figure 9:
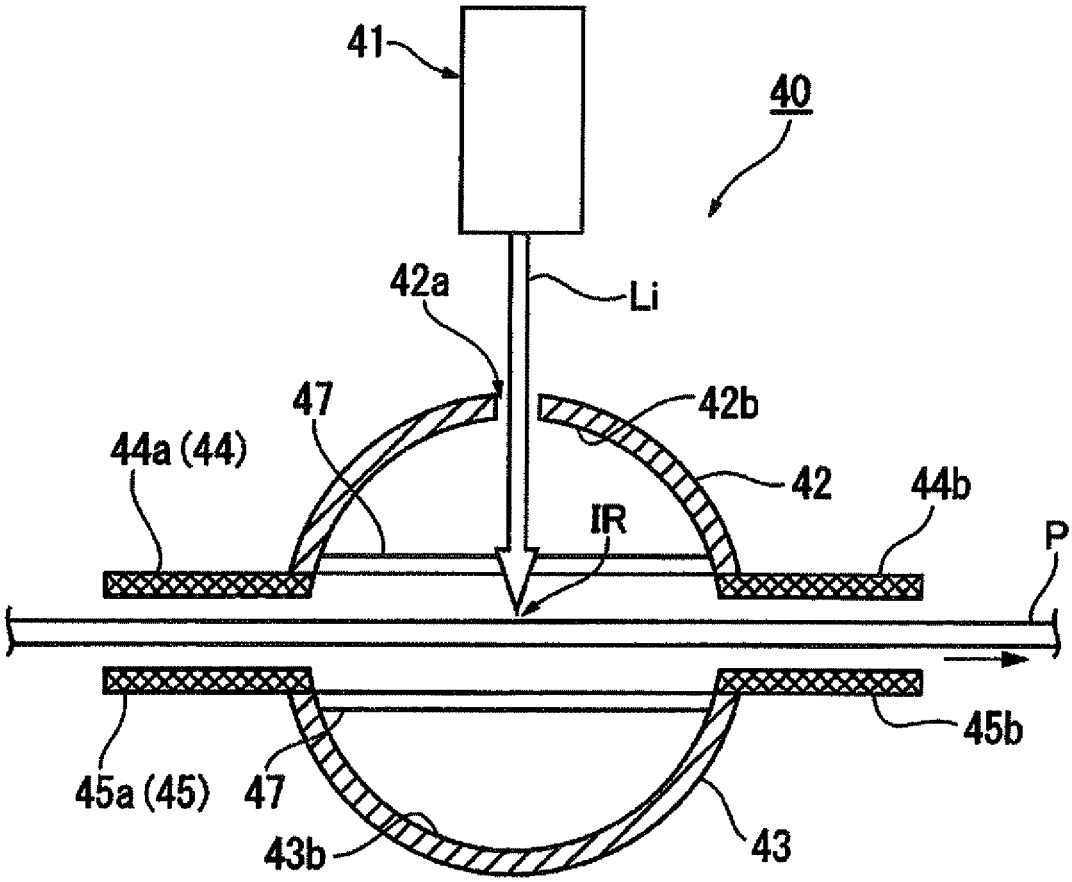
FIG. 9 is an explanatory diagram illustrating a fixing device of a second modification of the first embodiment.

Moreover, FIG. 9 illustrates a second modification of the fixing device 40 of the first exemplary embodiment, and the second modification is similar to the configuration of FIG. 6. However, in the second modification, protection members 47, which are installed opposite to the recording medium P side, are attached to the reflective member 42 and the rear surface side reflective member 43, respectively.

The protection members 47 are made of a material in which the laser light Li is transmissive, and an attenuation of the protection member is small with respect to the laser light Li, the reflected light Lr, and the transmission-light Lt (refer to FIG. 6). Therefore, the lights may be effectively used, and the heat resistance at the time of fixing is also provided.

Generally, in the method in which the toner, which is on the recording medium P, is heated, fused so as to be fixed, when the toner is heated and fused, for example, an additive agent constituting the toner is evaporated. Therefore, for example, if the vaporized material is attached to the reflective surface 42*b* of the reflective member 42, the reflection efficiency of the reflective surface 42*b* is decreased. Further, since the recording medium P itself is also heated, the evaporation of water or the like is caused. Therefore, the water is also added and the reflection efficiency of the reflective surface 42*b* is further decreased. Further, this is also similarly generated in the rear surface side reflective member 43.

In this case, by installing the protection members 47, the reflection efficiency of the reflective surface 42*b* of the reflective member 42 or the reflective surface 43*b* of the rear surface side reflective member 43 is maintained, and the fixing efficiency is maintained in the state of stability. Further, the vaporized material is attached to the protection members 47, but the protection members may be properly cleaned. In addition, the attenuation of the laser light Li due to the attachment of the protection members 47 is remarkably small, and the effect due to the attachment is small as compared to the effect due to the decrease of the reflection efficiency in the reflective surfaces 42*b* and 43*b*.

Here, the aspect in which the protection members 47 are directly installed in the reflective member 42 or the rear surface side reflective member 43 is illustrated. However, the protection members may be installed separating to the reflective member 42 or the rear surface side reflective member 43.

Figure 10:
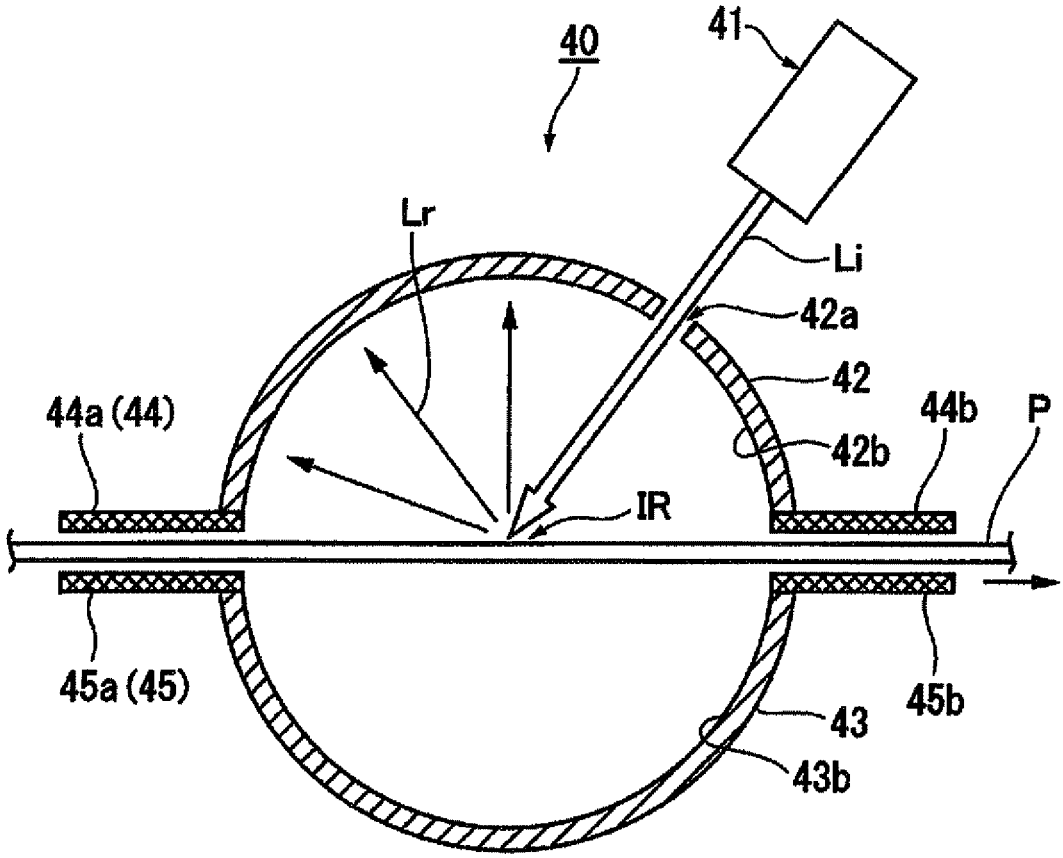
FIG. 10 is an explanatory diagram illustrating a fixing device of a third modification of the first embodiment.

Moreover, FIG. 10 illustrates a third modification of the first exemplary embodiment. In the third modification, the position of the slot 42*a* of the reflective member 42 is different to those of the embodiments and modifications described hereto.

In the third modification, the slot 42*a* of the reflective member 42 is installed at a position which is offset to the downstream side in the transporting direction of the recording medium P along the reflective surface 42*b*.

By adopting the disposition described above, the reflected light Lr from the irradiation region IR rather than the laser light Li from the laser array 41 is reflected more toward the upstream side in the transporting direction of the recording medium P than the slot 42*a* of the reflective member 42. However, since the upstream side portion is provided with the broad reflective surface 42*b*, the reflected light Lr is easily re-radiated toward the irradiation region IR. Therefore, the advancement of the fixing efficiency is improved. Further, in this case, the above effect is similarly applied even when the slot 42*a* of the reflective member 42 is provided so as to be offset to the upstream side in the transporting direction of the recording medium P.

Moreover, in the third modification, the aspect is illustrated in which the lens array 41 is installed in positions more distant from the recording medium P than from the reflective member 42. However, for example, the lens array 41 may be close to the recording medium P side and may radiate the laser light Li from a position which is same as the position of the reflective surface 42*b* of the reflective member 42. Further, the lens array may be disposed at the inner side (further in than the reflective surface 42 toward the recording medium P side) of the reflective member 42.

Further, in the third modification, the configuration is illustrated in which the continuous form is used as the recording medium P. However, the sheet-like form may be used as the recording medium, and in this case, for example, a guide mechanism for guiding the recording medium P toward the fixing device 40 or a transporting mechanism for transporting the recording medium P may be separately provided.

Moreover, in the above described embodiments and modifications, the aspect in which one irradiation region IR is provided is illustrated. However, for example, plural of laser arrays 41 may be provided in the transporting direction of the recording medium P.

Figure 11:
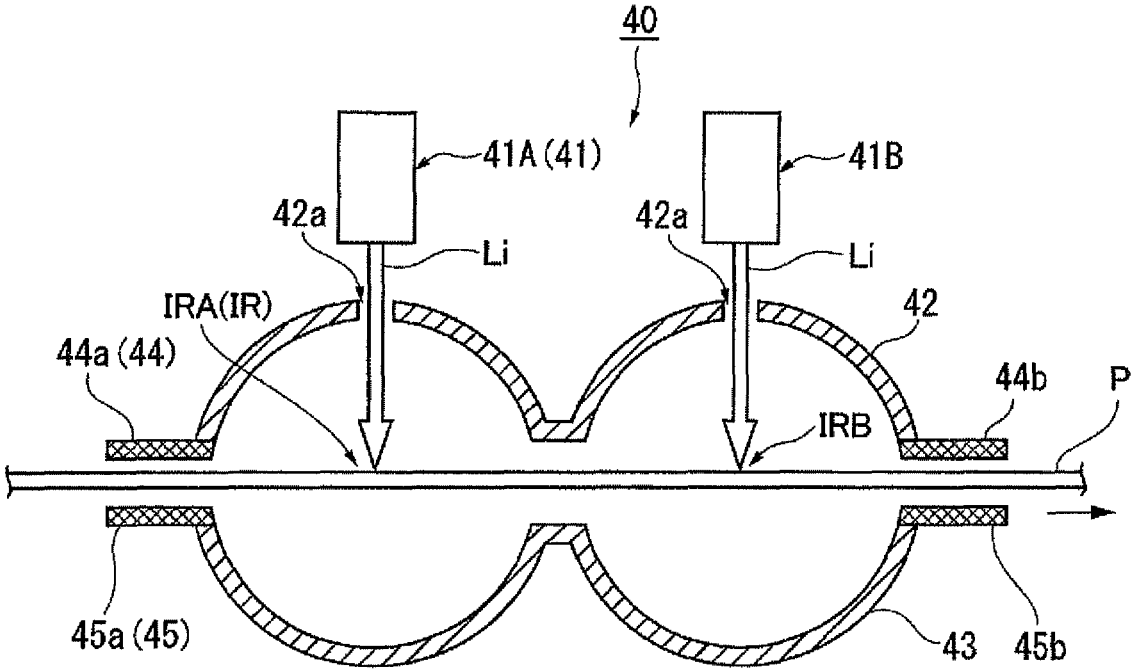
FIG. 11 is an explanatory diagram illustrating a fixing device of a fourth modification of the first embodiment.

FIG. 11 illustrates a fourth modification of the first exemplary embodiment. In the fourth modification, two cylindrical curved surfaces are provided along the transporting direction of the recording medium P of one reflective member 42, and the laser light Li radiates from two laser arrays 41 (41A and 41B) through respective slots 42*a*. Therefore, two places of the irradiation region IR (IRA, IRB) are provided. Further, the rear surface side reflective member 43 is provided similarly as the reflective member 42. In addition, a light absorption member 44 (44*a* and 44*b*) or a rear surface side light absorption member 45 (45*a* and 45*b*) is provided in portions of the upstream side and downstream side along the transporting direction of the recording medium P of the reflective member 42 and the rear surface side reflective member 43.

In the configuration of the fourth modification, first, the irradiation region IRA is irradiated with the laser light Li by the upstream side-laser array 41A with respect to the image which is on the recording medium P. Then, after a predetermined time elapses, the laser light Li again radiates the irradiation region IRB by the downstream side-laser array 41B.

When irradiating as described above, in a portion having a high image density on the recording medium P (for example, a beta image portion), an interface temperature between the toner and the recording medium P is slightly increased in the upstream side-irradiation region IRA. Thereafter, since the interface temperature is gradually decreased in portions in which the laser light does not radiate, a distribution area having a high image density becomes small, and a heat-dissipation amount is decreased. Therefore, a temperature decrease is suppressed to be small.

Next, by heating the downstream side-irradiation region IRB once again, the interface temperature is sufficiently increased, and a sufficient adhesion is secured.

On the other hand, the interface temperature is sufficiently increased in a portion having a low image density (for example, a highlighted image portion), but the temperature is rapidly decreased. Further, the portion is heated in the downstream side-irradiation region IRB once again, and the increase of the interface temperature is accomplished once again. That is, the interface temperature is secured by irradiating in the portion having the low image density once while the interface temperature is secured by irradiating in the portion having the high image density twice, and the above process is repeated.

Therefore, sufficient adhesion is secured in any one case regardless of the image density of the recording medium P. Further, the leakage of the light to the outside is suppressed by the light absorption member 44 and the rear surface side light absorption member 45.

Moreover, in the case where two places of the irradiation region IR are provided as the described above, the following may be performed.

The laser output of the upstream side-irradiation region IRA is less than the laser output of the downstream side-irradiation region IRB, and the irradiation region length is longer along the transporting direction of the recording medium P by that degree. Therefore, the irradiation time of the downstream side-irradiation region IRB is long. At this time, needless to say, the irradiation density or the irradiation region length matches the portion having the high image density so as to sufficiently heat and fuse the image in the upstream side-irradiation region IRA.

When the irradiation described above is performed, the adhesion of the portion having the high image density is sufficiently secured in the upstream side-irradiation region IRA, and it is not a problem even when irradiation of a short duration is performed in the downstream side-irradiation region IRB. On the other hand, in the portion having the low image density, as a contact area between a toner particle and outside air is broad in the irradiation by the upstream side-irradiation region IRA, the heat-dissipation amount is increased and the toner may not be sufficiently heated and fused. However, since the irradiation intensity is increased in the downstream side-irradiation region IRB, sufficient fusion is improved and the adhesion is secured. That is, sufficient heating and fusion of the toner is achieved regardless of the image density of the recording medium P.

Moreover, in the case where plural of irradiation regions IR is provided, for example, as illustrated in FIG. 10, needless to say, the slot 42*a* of the reflective member 42 may be offset to the upstream side or the downstream side in the transporting direction of the recording medium P.

(Second Exemplary Embodiment)

Figure 12:
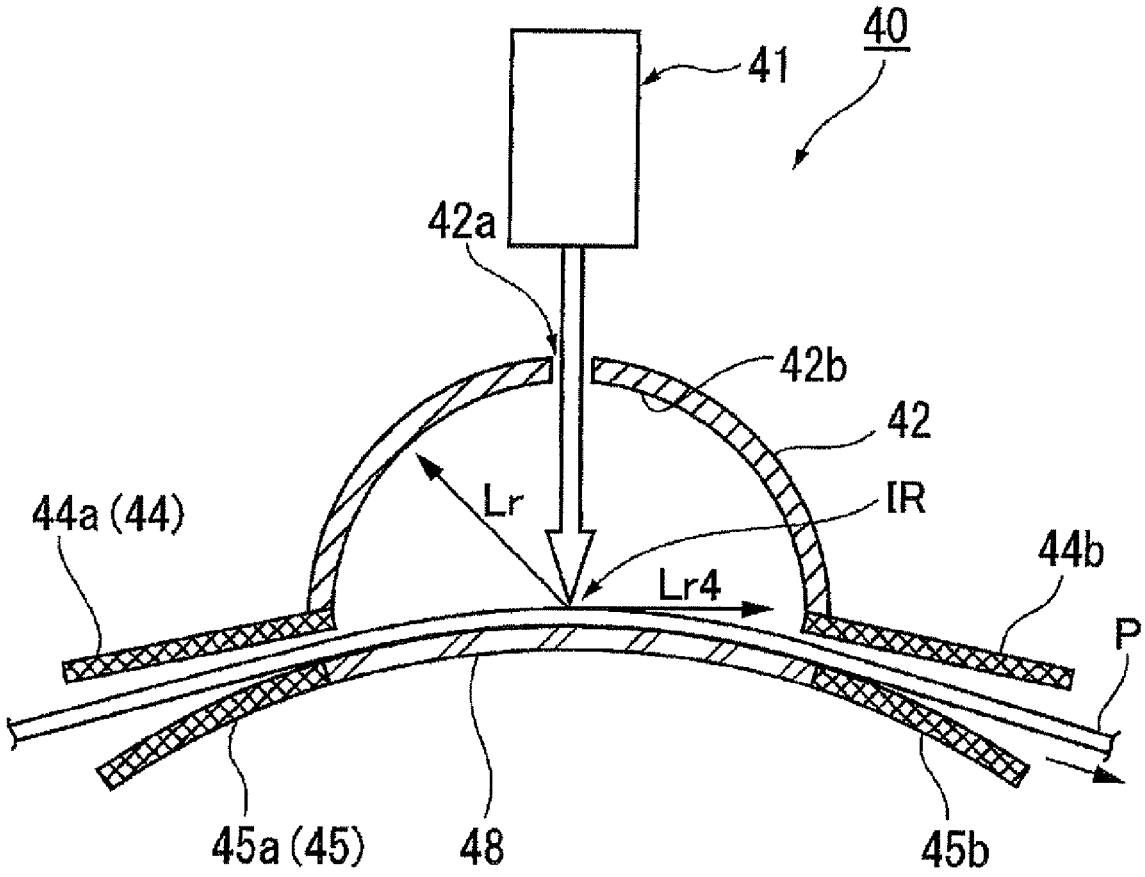
FIG. 12 is an explanatory diagram illustrating an outline of a fixing device of a second embodiment.

FIG. 12 is an explanatory diagram illustrating an outline of a fixing device 40 of a second exemplary embodiment.

The fixing device 40 of the second embodiment does not include the rear surface side reflective member different to the fixing device 40 of the first embodiment (for example, refer to FIG. 6), and the disposition of the light absorption member 44 is different to the disposition of the rear surface side light absorption member 45. Further, the same reference numbers are attached to the same components as the first exemplary embodiment, and the detailed description thereof is omitted here.

In FIG. 12, in a position facing the reflective member 42 which interposes the recording medium P, a curved shape-facing member 48, which is oppositely disposed so as to hold the recording medium P toward the laser array 41 side, is provided. The surface of the facing member 48 is a white color processed with a low friction processing by, for example, fluorine resin, and has a curved shape made of a heat-resistant material.

In the fixing device 40 described above, since the recording medium P is always transported while sliding on the facing member 48, the floppiness of the recording medium P in the irradiation region IR is also suppressed, and the laser output directed to the recording medium P in the irradiation region IR is easily equalized.

Further, by using the facing member 48, since the transmission light in which the irradiation region IR which transmitted through the recording medium P irradiated with the laser light Li is reflected by the surface of the facing member 48, even in the aspect where the rear surface side reflective member is not provided, the reflected light reflected from the transmission light which is close to the irradiation region IR is re-radiated, and therefore, the fixing efficiency is improved.

Moreover, in the second exemplary embodiment, the light absorption member 44 is installed so as to be directed to the rear surface side light absorption member 45 side rather than to the end of the reflective member 42 side while the rear surface side light absorption member 45 is installed along the curved shape of the facing member 48. That is, since the light absorption member 44 includes a surface which crosses to a tangential surface (a surface which is extended to the tangential direction) abutting the surface of the recording medium P in the irradiation region IR, a reflected light Lr4, which is approximately parallel to the surface of the recording medium (the direction corresponding to the tangential surface described above) in the irradiation region IR of the reflected light Lr reflected from the irradiation region IR, is absorbed in the light absorption member 44. Therefore, the leakage of the light to the outside is further suppressed. At this time, since the length of the irradiation region IR along the transporting direction of the recording medium P is shortened, the reflected light Lr which is close to the recording medium P out of the reflected light Lr reflected from the irradiation region IR substantially matches the reflected light Lr4.

Moreover, in the facing member 48 of the second exemplary embodiment, the curvature of the curved shape is especially not limited. That is, the curved shape may not deform the transported recording medium P, and, for example, the curved shape may be flat in the irradiation region IR. Further, the facing member 48 may be made of a metal material as long as the material has heat resistance, and it is preferable that the facing member has a high reflectivity so as to not easily absorb the transmission light in the irradiation region IR.

(Third Exemplary Embodiment)

Figure 13:
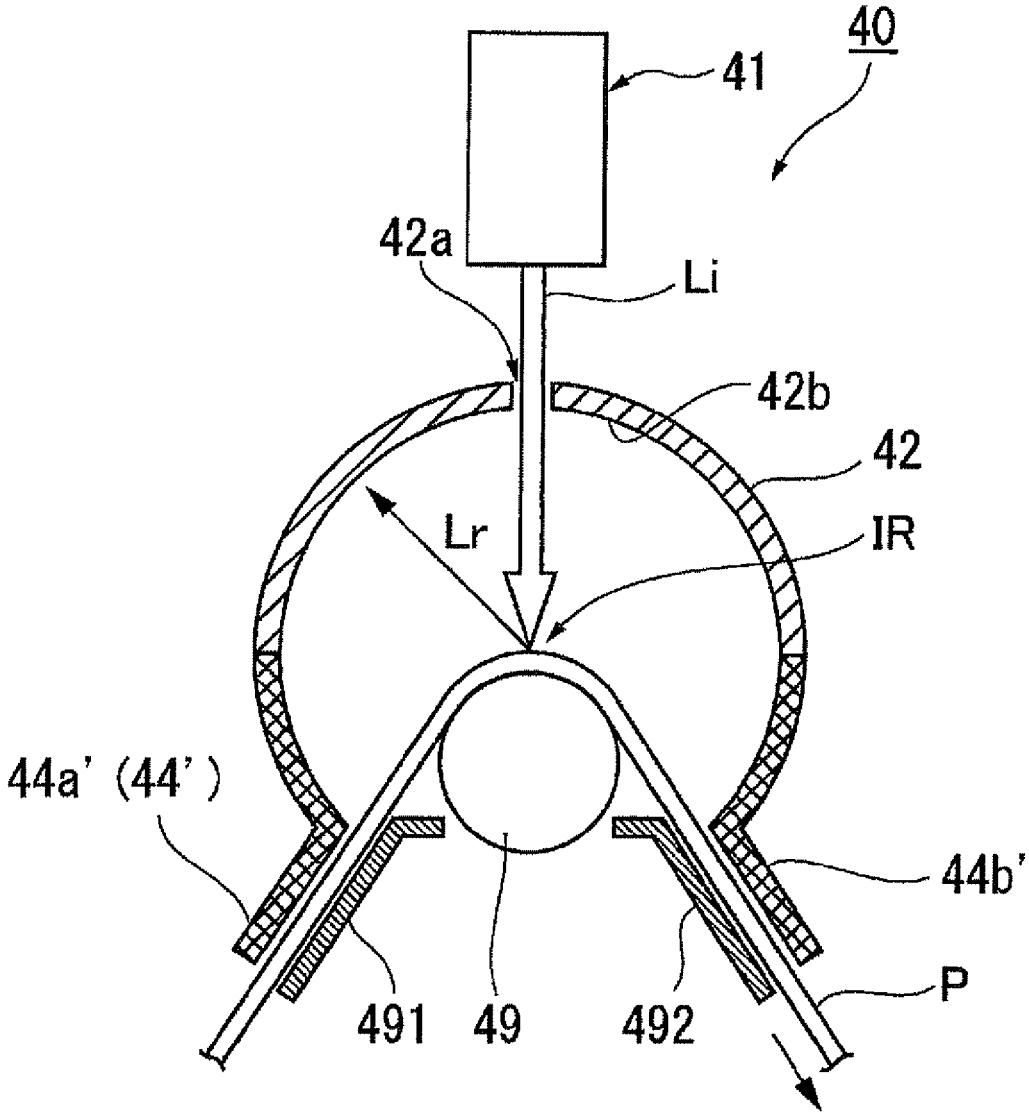
FIG. 13 is an explanatory diagram illustrating an outline of a fixing device of a third embodiment.

FIG. 13 is an explanatory diagram illustrating an outline of a fixing device 40 of a third exemplary embodiment. The fixing device 40 of the third exemplary embodiment does not include the rear surface side reflective member similarly to the fixing device 40 of FIG. 12, and does not include the rear surface side absorption member. Further, the same reference numbers are attached to the same components as the first exemplary embodiment, and the detailed description thereof is omitted here.

In FIG. 13, the fixing device 40 of the third exemplary embodiment includes: a rotation member 49 which is provided in the rear surface side of the recording medium P facing the irradiation IR; and guide members 491 and 492 which guide the recording medium P and are provided in the rear side of the recording medium P of the upstream side and the downstream side in the transporting direction of the recording medium of the rotation member 49.

Further, in the third exemplary embodiment, a reflective member 42 is provided to enclose the irradiation region IR in a state of extending to a position which crosses a tangential surface of the recording medium P in the irradiation region IR. In addition, a light absorption member 44' (44*a'* and 44*b'*) is provided in which the light absorption member includes a curved portion which is extended from the ends of the reflective member toward the surface side of the recording medium P and a straight line portion which faces the transporting surface of the recording medium P and is directed to the outside of the reflective member 42.

In the fixing device 40 of the third exemplary embodiment, as compared to the fixing device 40 having the aspect where the recording medium P is transported in the approximate straight line direction (for example, refer to FIG. 6), the reflective light Lr reflected from the irradiation region IR is less directed to the light absorption member 44'. However, the light reflected in the reflective surface 42*b* of the reflective member 42 is directed to the light absorption member 44' side. Also in the above case, since the light is absorbed in the light absorption member 44', the leakage of the light from the fixing device 40 is suppressed.

In the third exemplary embodiment, the aspect is illustrated in which the light absorption member 44' includes the curved portion which is extended to the reflective member 42. However, the reflective member 42 may include the curved portion. In this case, the reflective surface 42*b* becomes larger, and the use efficiency of the laser light Li is further improved.

(Fourth Exemplary Embodiment)

Figure 14:
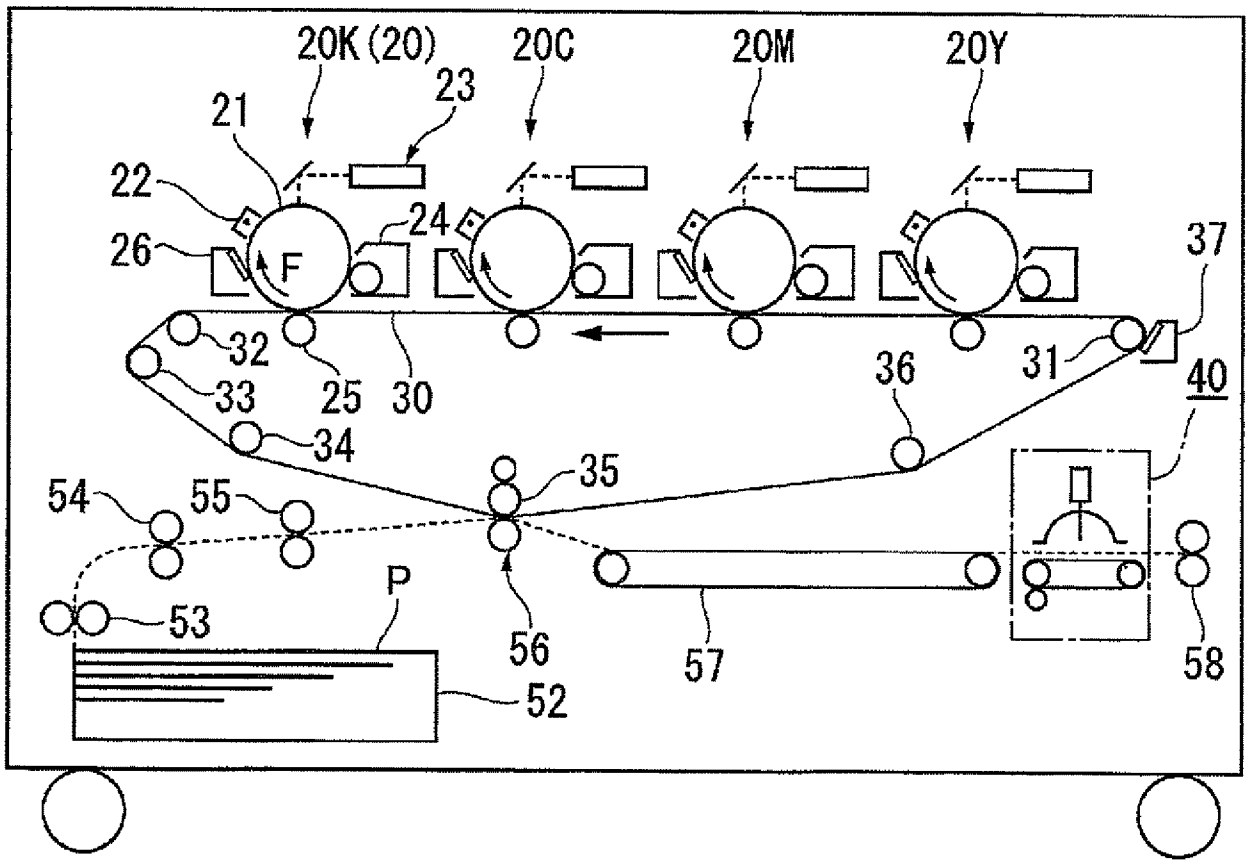
FIG. 14 is an explanatory diagram illustrating an outline of an image forming apparatus in which a fixing device of a fourth embodiment is applied.

FIG. 14 illustrates an outline of an image forming apparatus in which a fixing device 40 of a fourth exemplary embodiment is applied. The image forming apparatus of the present exemplary embodiment is different from the image forming apparatus of the first exemplary embodiment (refer to FIG. 4) in the view of using a sheet-like recording medium as the recording medium. Further, the same reference numbers are attached to the same components as the first exemplary embodiment, and the detailed description thereof is omitted here.

In FIG. 14, the image forming apparatus, for example, uses an electro-photographic method, and includes: image forming portions 20 (specifically, a black image forming portion 20K, a cyan image forming portion 20C, a magenta image forming portion 20M, and a yellow image forming portion 20Y) of respective colors for forming a toner image of plural of colors on the recording medium P (sheet-like) by using, for example, toners of four colors; an intermediate transfer 30 which is belt-shaped and transports in a state of multiplexing the toner images of respective colors formed in the image forming portions 20 of the respective colors; a batch transfer unit (a secondary transfer unit) 56 for batch-transferring the multiplexed toner images which are on the intermediate transfer 30, for example, on the recording medium P; and a fixing device 40 for fixing unfixed toner images which are transferred on the recording medium in the second transfer unit 56, or the like.

Here, the image forming portions 20 of the respective colors have an approximately similar configuration except for the toners used. Further, since the configuration of the image forming apparatus of the fourth exemplary embodiment is similar to that of the image forming apparatus 20 of the first exemplary embodiment (refer to FIG. 4), the detailed description thereof is omitted here.

The intermediate transfer 30 of the fourth exemplary embodiment is hung over plural of pull-suspension rolls 31 to 36. For example, the pull-suspension roll 31 is rotated as a driving roll, and the pull-suspension roll 34 is rotated as a tension roll.

Further, the secondary transfer unit 56 is arranged with the pull-suspension roll 35 as a backup roll, and a belt-cleaning unit 37 for cleaning the toner which remains on the intermediate transfer 30 is provided at a position, which is the position facing the pull-suspension roll 31, which interposes the intermediate transfer 30.

Moreover, a receiving portion 52 of the recording medium for receiving the recording medium P is provided downward from the intermediate transfer 30 within the image forming apparatus. Further, plural of transporting rolls 53 to 55 is provided between the receiving portion 52 of the recording medium and the secondary transfer unit 56 in a transporting path of the recording medium P transported from the receiving portion of the recording medium. In addition, a transporting belt 57 for transporting the recording medium P ended with the secondary transfer toward the fixing device 40, and a discharging roll 58 for discharging the recording medium P fixed by the fixing device 40 to the outside of the image forming apparatus are provided in the transporting path.

Therefore, in the fourth exemplary embodiment, since the toner images of the respective colors formed on a photoconductor drum 21, which is rotated in the F direction of FIG. 14 in the image forming portions 20 of the respective colors, are transferred on the intermediate transfer 30 in the transfer unit (a primary transfer device) 25, the multiplexed toner images are formed on the intermediate transfer 30. Meanwhile, the recording medium P is transported from the receiving portion 52 of the recording medium to the secondary transfer position by the transporting rolls 53 to 55, and the toner images multiplexed on the intermediate transfer 30 are batch-transferred on the recording medium P in the secondary transfer unit 56. The recording medium P on which the multiplexed toner images are batch-transferred in the secondary transfer unit 56 is transported unchanged to the transporting belt 57, and is fixed in the fixing device 40. The recording medium P ending the fixing is discharged to the outside of the image forming apparatus by the discharging roll 58.

Figure 15:
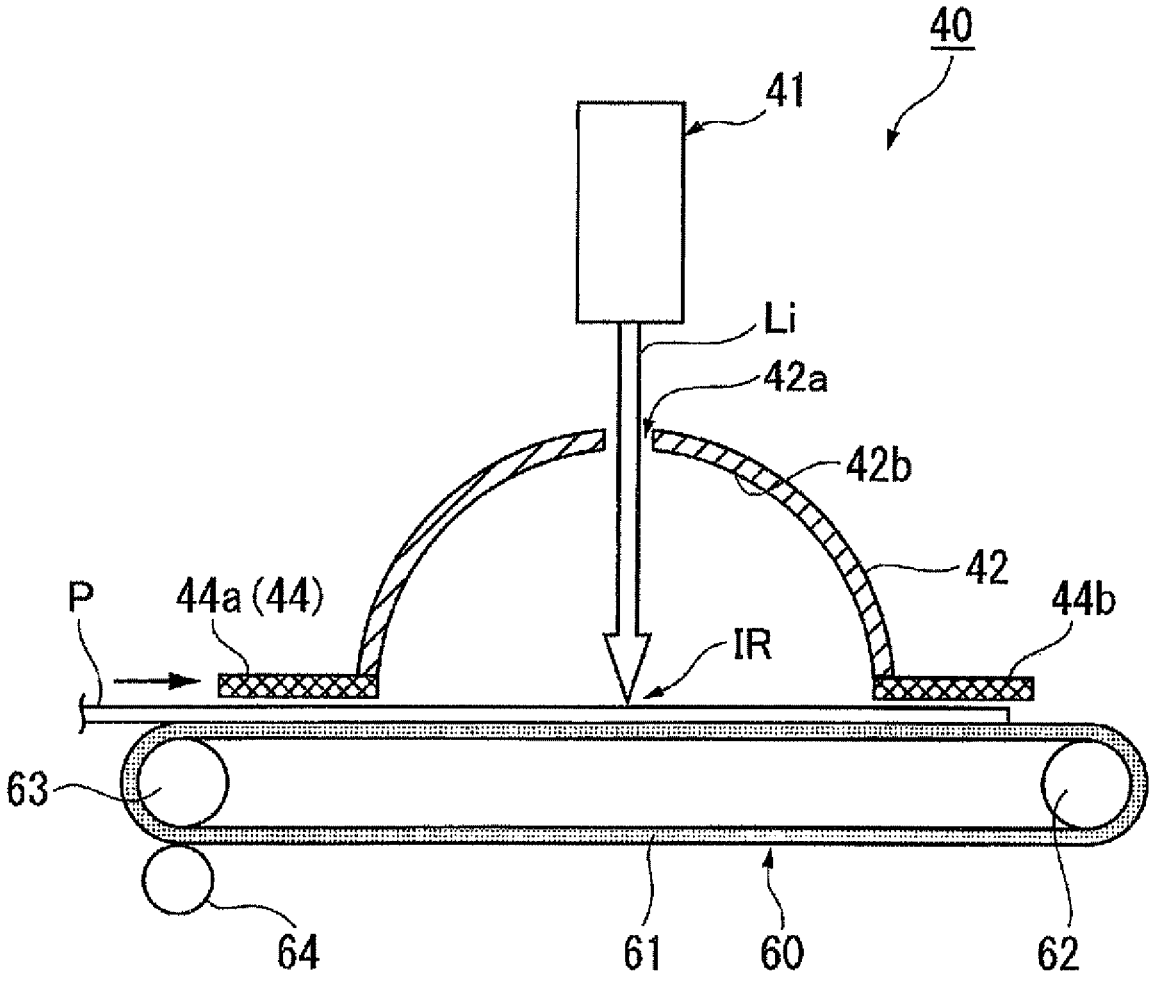
FIG. 15 is an explanatory diagram illustrating an outline of the fixing device of the fourth embodiment.

FIG. 15 illustrates an outline of the fixing device 40 in the fourth exemplary embodiment. For example, an adsorption-transporting device 60 of an electrostatic adsorption type for holding and transporting the recording medium P is provided in a position facing the reflective member 42 which interposes the recording medium P.

The adsorption-transporting device 60 includes: two roll members 62 and 63; a belt member 61 which is cyclically rotated and hung over the two roll members 62 and 63; and a charging member 64 for applying electrification to the belt member 61.

In the fixing device 40 of the fourth exemplary embodiment, when the recording medium P on which the unfixed toner image is transferred reaches the fixing device 40, since the belt member 61 of the adsorption-transporting device 60 is charged by the charging member 64, the recording medium P is electrostatically adsorbed to the belt member 61 side, and is transported unchanged according to the rotation of the belt member 61. After the recording medium P transported by the rotation of the belt member 61 is irradiated by the laser light Li from the lens array 41 in the irradiation region IR, the recording medium P is transported unchanged to the downstream side again according to the rotation of the belt member 61. Further, since a peeling member is provided for easily peeling the recording member P from the adsorption-transporting device 60 after fixing, peeling of the recording medium P from the belt member 61 is also performed easily.

In the fourth exemplary embodiment, the light absorption member 44 (44*a* and 44*b*) is provided with the portion which extending to the end portion of the side toward the recording medium P of the reflective member 42 and facing the transporting surface of the recording medium P and extending the outside of the reflective member 42

In the fourth exemplary embodiment, similarity to the first exemplary embodiment, the leakage of light from the fixing device 40 is suppressed.

Further, in the fourth exemplary embodiment, by using the adsorption-transporting device 60, the posture of the recording medium P is stably maintained in the irradiation region IR even when the recording medium P is sheet-like, and the irradiation intensity of the laser light Li is also equalized in the irradiation region IR. Further, as the belt member 61 used in the adsorption-transporting device 60, the surface thereof may be made so that the transmission light which transmitted through the recording medium P rather than the laser light Li of the irradiation region IR reflects in the rear surface side of the recording medium P, and, for example, a white-type pigment may be added to the belt member.

Here, the aspect in which the charging member 64 abuts the belt member 61 is illustrated. However, for example, by using a corona charger or the like, the belt member 61 may be charged in a state where the charging member is separated from the belt member 61. Further, the aspect in which the recording medium P is electrostatically adsorbed by the adsorption-transporting device 60 is illustrated. However, the recording medium may be air-sucked from the rear surface side of the belt member 61. In addition, the method in which the belt member 61 is pull-suspended by two roll members 62 and 63 is illustrated. However, for example, a facing member (for example, a roll-shaped member) is provided corresponding to the irradiation region IR, and the vicinity of the irradiation region IR may be protruded toward the lens array 41 side.

(Fifth Exemplary Embodiment)

In the exemplary embodiments and modifications described above, it is possible to view the reflective surface 42*b* of the reflective member 42 from the opening section α (refer to FIG. 6) between the recording medium P and the light absorption member 44. However, in order to further decrease the leakage of the light, when viewing the irradiation region IR from the opening section α, it is preferable that only the facing surface of the light absorption member 44 facing the transporting surface of the recording medium P is viewed. Herewith, the leakage of the light is substantially suppressed.

Therefore, in the fifth exemplary embodiment, by considering the shape of the light absorption member 44 and the transporting path of the recording medium P, the leakage of the light is substantially suppressed.

Figure 16A:
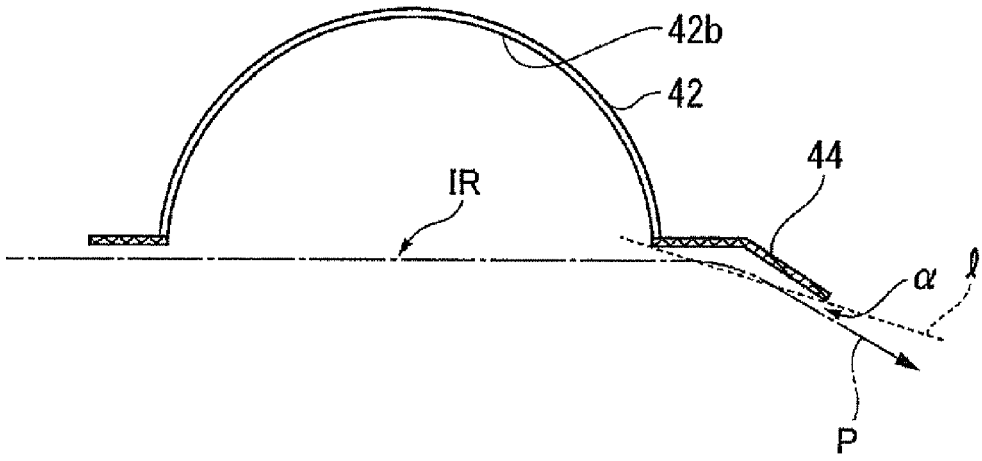
FIG. 16A is a pattern diagram illustrating a main part of a fixing device of a fifth embodiment.

FIG. 16A is a pattern diagram illustrating an example of a relation of the shape of the reflective member 44 and the transporting path (shown as a dotted line in FIGS. 16A and 16B) of the recording medium P, and the recording medium P is flatly transported in an enclosing portion of the reflective member 42. Further, FIG. 16B illustrates a partial enlarged view of FIG. 16A.

Figure 16B:
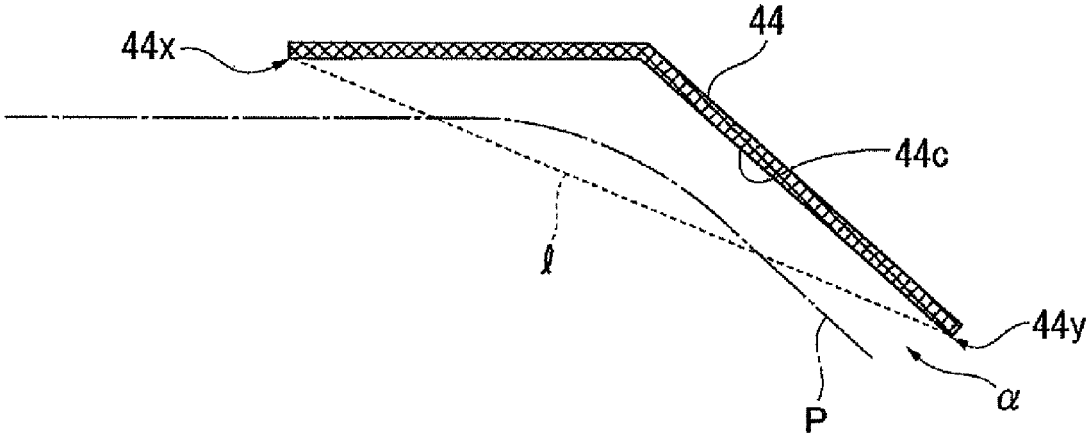
FIG. 16B is a partial enlarged view of FIG. 16A.

Referring to FIGS. 16A and 16B, in a portion facing the transporting surface of the recording medium P of the light absorption member 44, when drawing a straight line 1 connecting two different points (both ends 44*x* and 44*y* in the fifth exemplary embodiment) in the transporting direction of the recording medium P of the facing surface 44*c* facing the recording medium P, the light absorption member 44 and the transporting path of the recording medium are provided so that the facing surface 44*c* of the light absorption member 44 includes portions which are further distant from the recording medium P than from the straight line 1 and the transporting path of the recording medium P is provided in the portion.

Therefore, even when viewing the irradiation region IR from the opening section α, the facing surface 44*c* of the light absorption member 44 is viewed, and the irradiation region IR direction is not viewed.

Therefore, the irradiation region IR or the reflective surface 42*b* of the reflective member 42 are not viewed from the opening section α, and, for example, the light reflected from the reflective surface 42*b* of the reflective member 42 does not leak from the opening section α toward the outside, and safety is further enhanced.

Here, it is illustrated that the light absorption member 44 has a bending shape, but the light absorption member 44 may have a curved shape. Further, as the shape of the absorption member 44, for example, the absorption member may be a serpentine. The point is as follows: it is preferable that in the portion facing the transporting surface of the recording medium P in the light absorption member 44, the transporting path of the recording medium P is provided between the straight line connecting two different points in the transporting direction of the recording medium of the facing surface 44 facing the transporting surface of the recording medium P and surfaces which are further distant from the recording medium P of the facing surface 44*c* than from the straight line 1.

Figure 17A:
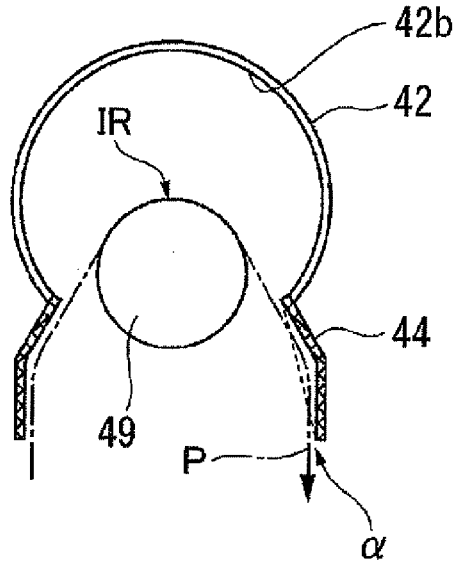
FIG. 17A is a pattern diagram illustrating a main part of a fixing device as a modification of the fifth embodiment.
Figure 17B:
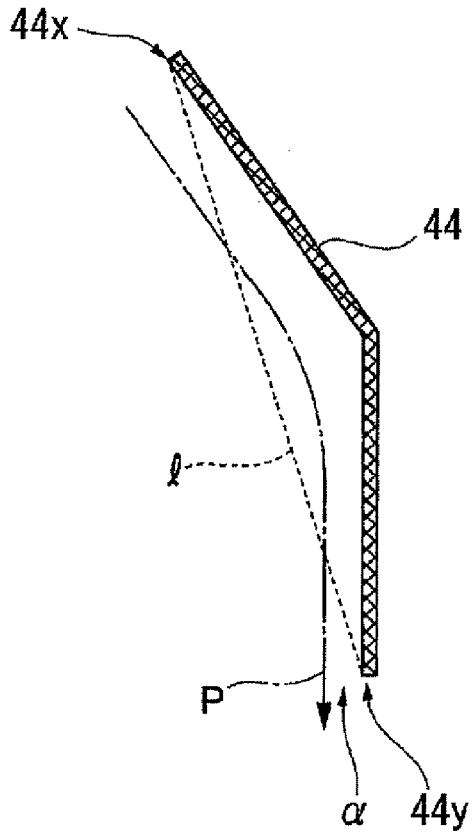
FIG. 17B is a partial enlarged view of FIG. 17A.

Moreover, FIGS. 17A and 17B illustrate a modification of the fifth exemplary embodiment, and FIG. 17A is a pattern diagram, and FIG. 17B is a partial enlarged view.

Referring to FIGS. 17A and 17B, in the modification of the fifth exemplary embodiment, the recording medium P is rotated around a rotation roll 49 and transported. Also in the case, since the transporting path in which the recording medium P is transported is provided between the straight line 1 connecting the both ends 44*x* and 44*y* of the light absorption member 44 and the light absorption member 44, the irradiation region IR or the reflective surface 42*b* of the reflective member 42 is not viewed from the opening section α, and the leaked light is also not directed to the outside from the opening section α. Therefore, safety is further enhanced.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. A fixing device comprising:

a laser light source that irradiates an irradiation region with a laser light, the irradiation region extending along a direction crossing a transporting direction of a recording medium with respect to a heating-fixable image which is on the recording medium;

a reflective member that is provided to enclose the irradiation region and includes a reflective surface reflecting a reflected light so that the irradiation region is re-irradiated with the reflected light from the irradiation region by the laser light radiated from the laser light source; and a light absorption member that is provided so as to continue to an end of a side of the reflective member directed to the recording medium and includes a portion facing a transporting surface of the recording medium and extending toward an outside of the reflective member, and is capable of absorbing the laser light.

2. The fixing device according to claim 1, wherein the light absorption member includes a surface that crosses tangential surface of the recording medium in the irradiation region.

3. The fixing device according to claim 1, further comprising:

a rear surface side light absorption member that is disposed to face the light absorption member which interposes the recording medium therebetween, and capable of absorbing the laser light.

4. The fixing device according to claim 1, further comprising:

a rear surface side reflective member that is provided in the region facing the reflective member which interposes the recording medium therebetween, and reflects a transmission light so that the region of a rear surface side of the recording medium corresponding to the irradiation region is re-irradiated with the transmission light radiated from the laser light source and transmitted through the recording medium.

5. The fixing device according to claim 1, wherein the light absorption member is disposed so that only a facing surface of the light absorption member facing the transporting surface of the recording medium is viewed when viewing the irradiation region from the opening section between the light absorption member and the recording medium at an outside end, and the outside end is other than the irradiation region side of portions of the light absorption member facing the transporting surface of the recording medium.

6. The fixing device according to claim 1, further comprising a cooling unit that cools the light absorption member.

7. An image forming apparatus comprising:

an image forming portion that forms a heating-fixable image on a recording medium; and a fixing device that fixes the image formed on the recording medium in the image forming portion and is according to claim 1.

8. The image forming apparatus according to claim 7, wherein the image forming apparatus forms an image on a recording medium that is continuous along a transporting direction.

* * * * *